US008864136B2

(12) United States Patent
Pedersen et al.

(10) Patent No.: US 8,864,136 B2
(45) Date of Patent: Oct. 21, 2014

(54) PROJECTILE TOY AND LAUNCHER THEREFOR

(71) Applicant: Tech 4 Kids Inc., Mississauga (CA)

(72) Inventors: Bradley D. Pedersen, Mississauga (CA); Kyle Jeffs, Mississauga (CA)

(73) Assignee: Tech 4 Kids, Inc., Ontario (CA)

( * ) Notice: Subject to any disclaimer, the term of this patent is extended or adjusted under 35 U.S.C. 154(b) by 146 days.

(21) Appl. No.: 13/627,397

(22) Filed: Sep. 26, 2012

(65) Prior Publication Data

US 2013/0081602 A1 Apr. 4, 2013

Related U.S. Application Data

(60) Provisional application No. 61/542,772, filed on Oct. 3, 2011.

(51) Int. Cl.

| | |
|---|---|
| ***A63F 7/06*** | (2006.01) |
| ***A63B 71/04*** | (2006.01) |
| ***A63H 33/00*** | (2006.01) |
| ***F42B 12/72*** | (2006.01) |
| ***F41B 3/03*** | (2006.01) |
| ***A63H 33/18*** | (2006.01) |

(52) U.S. Cl.

CPC ..... *A63H 33/18* (2013.01); *F42B 12/72* (2013.01); *F41B 3/03* (2013.01)

USPC ..... 273/317; 273/129 R; 446/75; 446/473

(58) Field of Classification Search

USPC ..... 446/429, 486; 124/5, 17, 20.1, 23.1; 473/515, 569

See application file for complete search history.

(56) References Cited

U.S. PATENT DOCUMENTS

| | | | | |
|---|---|---|---|---|
| 2,324,201 | A * | 7/1943 | Donaldson | 124/20.1 |
| 2,996,060 | A * | 8/1961 | Appleby | 124/41.1 |
| 4,250,861 | A * | 2/1981 | Ellenburg | 124/20.1 |
| 4,844,304 | A * | 7/1989 | Lenderink | 473/596 |
| 5,326,101 | A | 7/1994 | Fay | |
| 5,471,968 | A * | 12/1995 | Lee | 124/64 |
| 5,579,750 | A * | 12/1996 | Lease | 124/20.1 |
| 5,657,738 | A * | 8/1997 | Klundt | 124/17 |
| 6,050,871 | A | 4/2000 | Chen | |
| 6,109,998 | A * | 8/2000 | DiResta et al. | 446/184 |
| 6,527,616 | B1 * | 3/2003 | Li | 446/267 |
| 6,533,637 | B1 | 3/2003 | Liao | |
| 6,808,437 | B2 | 10/2004 | Podd et al. | |
| 6,908,662 | B2 | 6/2005 | Pearce | |
| 7,572,196 | B2 | 8/2009 | Kotze et al. | |
| 7,861,700 | B2 * | 1/2011 | Scoggins | 124/41.1 |
| 7,951,022 | B2 | 5/2011 | Yearick | |
| 2008/0081536 | A1 * | 4/2008 | Payne et al. | 446/75 |
| 2011/0232617 | A1 * | 9/2011 | Raymond | 124/20.1 |
| 2012/0082824 | A1 * | 4/2012 | Pedersen et al. | 428/195.1 |
| 2012/0196503 | A1 | 8/2012 | Walterscheid | |

* cited by examiner

*Primary Examiner* — Nini Legesse

(74) *Attorney, Agent, or Firm* — Adam K. Sacharoff; Much Shelist

(57) ABSTRACT

A toy projectile is provided which is preferably constructed of TPR, and thus, can be used as an inherently stretchable elastic toy projectile. A handle section is also provided which can be used as a projectile launcher. Further, a storage container is also provided which can also act as a projectile launcher. In a preferred embodiment, a game is also described in which the projectiles are launched by hand, or with the handle or by the storage container/launcher, in order to impact targets, and preferably moving targets. A child's toy projectile and projectile launcher, with a game, are thereby provided.

4 Claims, 4 Drawing Sheets

PROJECTILE TOY AND LAUNCHER THEREFOR

CROSS REFERENCE TO RELATED APPLICATIONS

The present application is a nonprovisional application of U.S. Application 61/542,772 filed Oct. 3, 2011.

FIELD OF THE INVENTION

The present invention relates to the field of toys, and in particular, relates to projectile toys, and the launchers used therewith.

BACKGROUND OF THE INVENTION

Historically toy projectiles and projectile launchers have relied upon the use of air pressure, catapults, elastics or springs to launch the projectiles. While these have proved popular, it would be advantageous to provide projectile toys which relied upon other projection means, and which resulted in the creation of new games as a result of the nature of the projectile.

SUMMARY OF THE INVENTION

An exemplary implementation of a projectile toy of the present invention is a projectile which is adapted to be stretched so as to create an elastic force, and in a preferred feature, a launcher which is adapted to exert a stretching force of the projectile toy, and then release the stretching force, causing the projectile to be projected.

As a result of the present invention, the "ammunition" of the projectile toy, also acts as to provide its own projection force, and preferably, by selection of the proper material, provides game features, as will be herein described. In a preferred embodiment, the projectile is manufactured from an elastic-type material, and in a most preferred embodiment, the projectile is manufactured from TPR.

Thermal Poly Rubber (TPR) is commonly used in the production of toys due to its extremely soft and flexible nature. Examples of typical toy products include stress relief balls, which are commonly filled with a liquid, and which undergo tremendous stretching, when squeezed. Additionally, because of its soft, and slightly tacky feel, TPR can be used in products such as the toy described in US Patent Publication No. 2005/0009442, in which a "wall-crawler" is provided which will "crawl" down the surface of a wall.

In the present invention, the toy projectiles are preferably manufactured of TPR, and are produced so as to facilitate stretching of the toy, in the manner of an elastic rubber band or the like. As such, the toys are preferably provided with an attachment point (e.g. a finger hook point, or attachment hook to a projectile launcher assembly), and a pulling point, for pulling the toy into a stretched condition.

Additionally, the toys can include stabilizing fins, or the like, in order to stabilize flight of the toy, when projected. Further, the toys can be colored and/or shaped so as to resemble characters, such as comic book heroes, or items such as spider webs, and the like.

A further feature of the projectiles of the present invention is that the TPR-based projectile has a tacky feeling due to the inherent tackiness of the TPR material. As such, the TPR-based projectile can be used as a projectile that will stick to a surface on impact. This feature replicates this feature from other projectiles, such as projectiles with suction cups at one end, or the like, however in the present invention, the entire projectile is capable of sticking to the impact surface.

As to the game feature, in its most generalized embodiment, the game of the present invention is a game wherein a projectile of the present invention (of any suitable shape), is projected against a target.

In a more preferred embodiment, a moving target is used. In particular, in a preferred embodiment, wall crawlers, such as those described in US 2005/0009442, or the like, can be positioned on a wall, so that the wall crawlers will begin moving down the wall. In the game of the present invention, the web shaped toy can be projected against the wall with the idea to remove the wall crawler from the wall.

The launcher of the present invention is preferably a handle having a hook for catching at least a portion of the attachment portion of the toy. The handle is use to hold the attachment portion while the other end of the toy projectile is pulled to create tension. When the toy projectile is released, the projectile flies forward, slides off of the hook on the handle so as to not interfere with the projectile trajectory, and flies towards the target.

This has similarities to a sling-shot, but in this application the projectile acts both as the projectile, and additionally as the elastic member used to propel the projectile. Moreover, the handle is used primarily used as a preferred embodiment, and the user might also simply use one finger to "hook" and hold the attachment portion.

The TPR toy can be a die-cut TPR product comprising a layer or layers of TPR. Air may be entrained within the TPR layers, so as to lighten the toy projectile. The TPR projectile can be cut, molded or formed into suitable shape, as desired. Further, the TPR toy can also be of any suitable color, and additionally, the TPR projectile can be formed of several TPR layers laid one over the other.

It should be noted that use of liquid-filled TPR toys is not generally preferred since the liquid filling increases the weight of the projectile, and thus, reduces the distance the projectile will fly. However, use of these types of TPR toys is not excluded from the present invention.

In a more preferred embodiment, a moving target is provided. In one preferred embodiment, wall crawlers, such as those described in US 2005/0009442, or the like, can be positioned on a wall, so that the wall crawlers will begin moving down the wall. In the game of the present invention, the toy projectiles are projected against the wall with the idea to hit the moving targets and/or remove them from the wall.

In a further embodiment, the projectile can be a TPR toy in the shape of a cage, a container, or a holding device, such as a spider's web. When projected against the wall, the toy will ensnare the target, and preferably, a moving target such as the wall crawlers mentioned hereinabove. As such, a novel game is provided which relies on the nature of the projectile toys of the present invention.

In a further aspect, the present invention also provides a projectile storage device, which opens to act as a projectile launcher. In this embodiment, a storage container is provided having room to store the projectile toy. The storage device opens by, for example, opening a lid, or by splitting the storage device essentially in half around a hinge. The storage device can incorporate an attachment portion integral with the opened storage container. In this manner, the storage device can also acts as the projectile launcher.

In a still further embodiment, one end of the projectile is affixed to the storage device, and the action to open the storage device is achieved by having a spring-loaded hinge, with a latching mechanism to hold the storage device shut. On releasing the storage device latch, the storage device opens, and expels the projectile from the storage device. The projected toy can be used to hit targets, and/or capture moving targets such as wall crawlers, and the like.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENTS

Figure 1C:
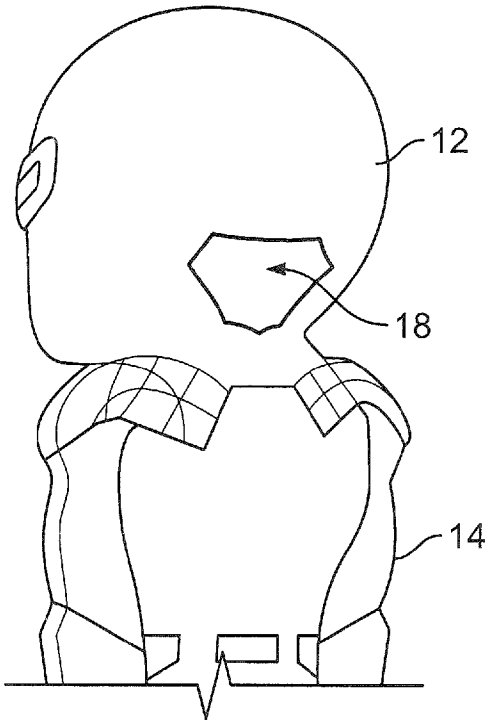
FIGS. 1A, 1B and 1C are back, side, and a rear perspective view of a first embodiment of a projectile of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention. Also, unless otherwise specifically noted, all of the features described herein may be combined with any of the above aspects, in any combination.

Figure 1B:
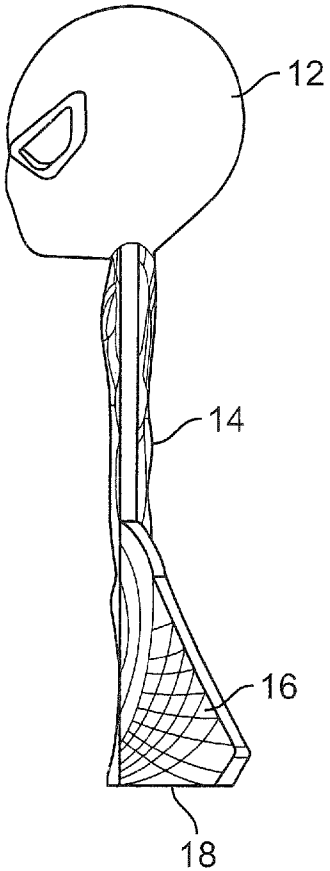
Figure 1A:
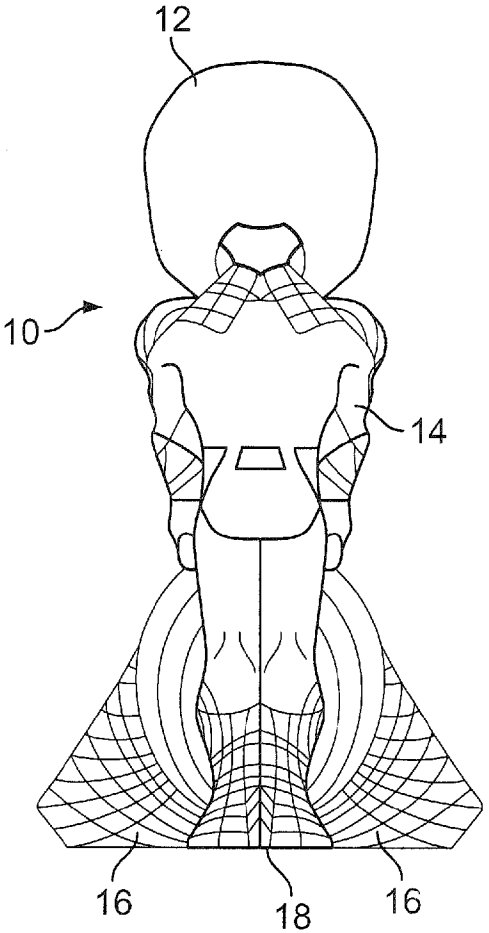

Referring to FIGS. 1A-1C, a first embodiment of a projectile toy 10 is shown having a head section 12, a body section 14, and stabilizing fins 16 at a terminal end 18 of toy 10. Behind the head section 12, is a finger hook area 20.

Toy 10 is made of a TPR material, and is inherently capable of being stretched, and thus apply elastic force to the stretched toy.

In use, the user hooks toy 10 using finger hook 20 in one hand, and stretches toy 10 by grabbing terminal end 18, and pulling to stretch toy 10. Once sufficient tension has been established, terminal end 18 is released, and the projectile toy 10 is projected.

Figure 2A:
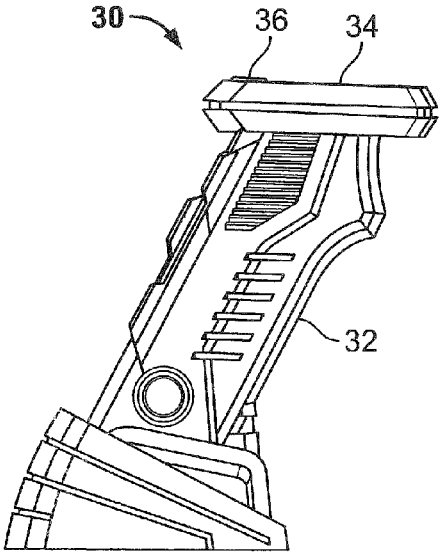
FIGS. 2A and 2B is a side view of a projectile launcher and a perspective view of an user holder the projectile launcher in accordance with one embodiment of the present invention.
Figure 2B:
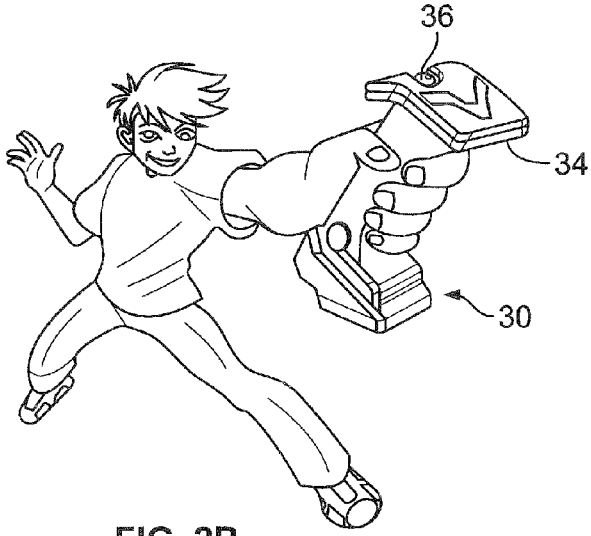

In FIG. 2A, a launcher handle 30 is shown, having a hand hold section 32, and an attachment section 34. In FIG. 2B, it can be seen that attachment section 34 includes a indentation into handle 30, and provides an attachment portion 36 to which projectiles can be attached. The launcher is used in a similar manner to that described with respect to FIG. 1.

Figure 3:
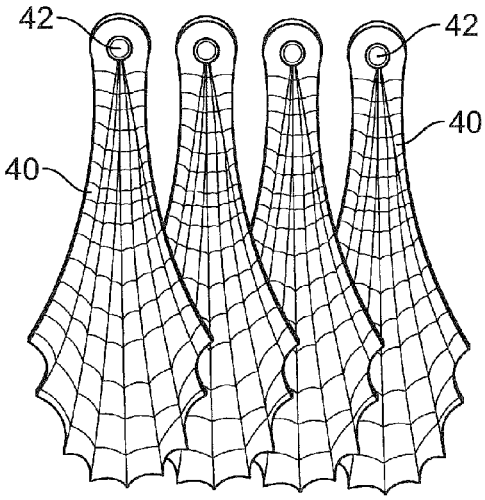
FIG. 3 is a front view of a plurality of projectiles in the shape of webs.

In FIG. 3, a plurality of projectiles 40 are shown. In this embodiment, all of the projectiles 40 have the general shape of a spider's web, but any suitable shape can be used. At one end of each of projectiles 40 is a loop 42 which is adapted to be fitted around the attachment portion 36 in attachment section 34 of launcher handle 30.

Figure 4:
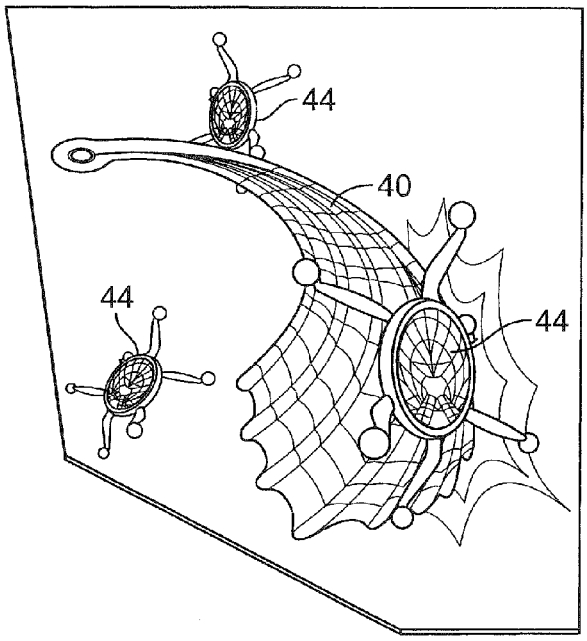
FIG. 4 is a perspective view of a projectile from FIG. 3 striking a moving target, namely a wall crawler.

In FIG. 4, a plurality of moving targets 44, such as web crawlers, having TPR feet, and adapted to slowly move down a wall surface, are shown. A projectile 40 is shown as contacting one of targets 44 after having been launched from handle 30.

Figure 5B:
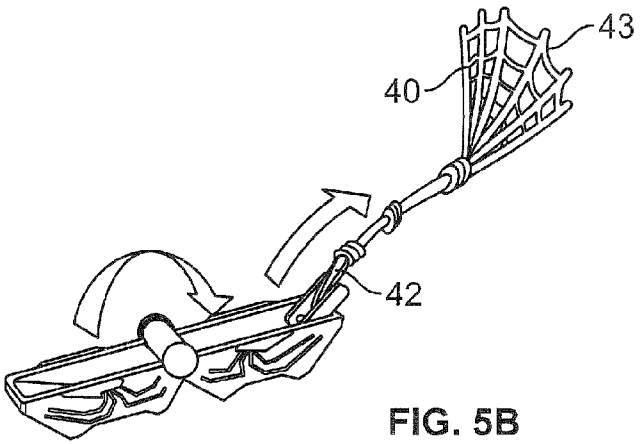
FIG. 5 is a series of drawings showing the function of the storage device as a projectile launcher.
Figure 5A:
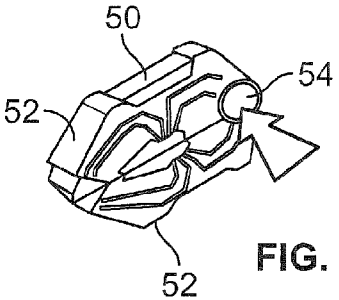
Figure 5C:
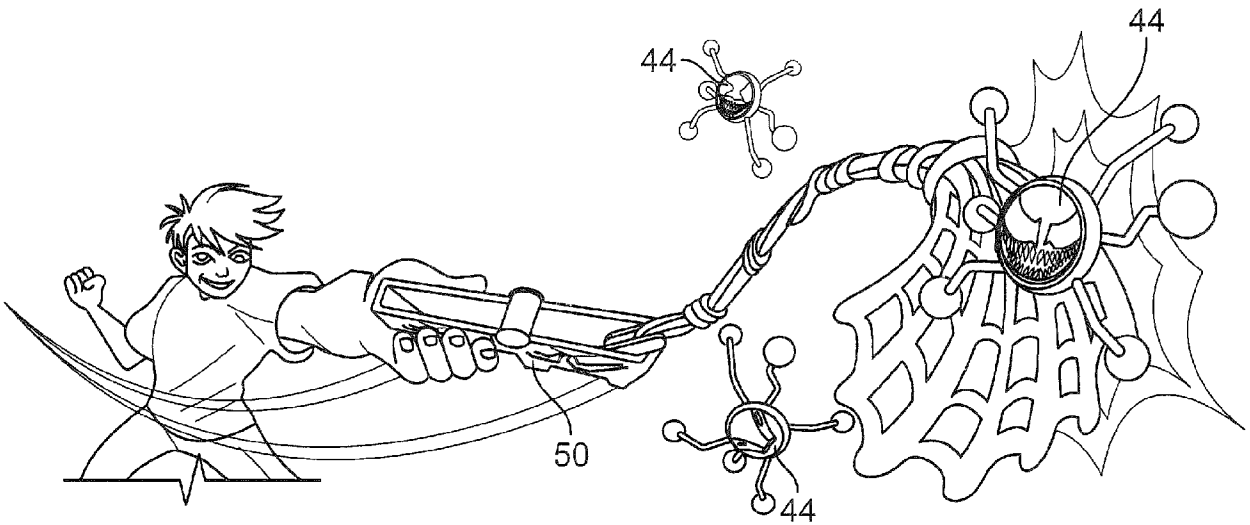

In FIGS. 5A, 5B and 5C, a series of drawings are provided showing a storage container 50 in which a projectile 40 is stored. Container 50 comprises two essentially identical halves 52 joined together by a hinge. The halves 52 of container 50 are attached to one another by a spring-loaded hinge section (not shown), and a latching mechanism 54 holds halves 52 together.

When latching mechanism 54 is activated, one half 52 rapidly moves 180° to be parallel to the other half 52. Loop 42 is essentially permanent connected to an attachment portion within container 50, but the action of container 50 opening causes the free end 43 of projectile 40 to be projected out of container 50. The action also causes projectile 40 to stretch to a length greater than its resting length, and extend to a point where it can impact a target, which again, is shown as a moving web crawler target 44.

To re-load the launcher 50, the user inserts projectile 40 back into its storage container 50, and moves the halves 52 of the container back together around the hinge. The halves 52 are then in position so that latching mechanism 54 can be re-engaged.

Figure 6A:
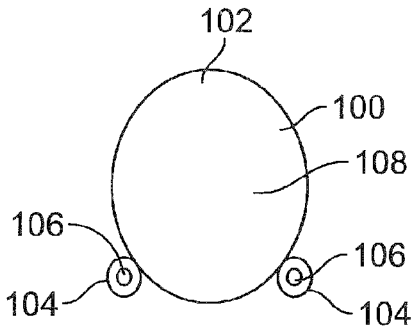
FIG. 6A is an example of a projectile provided in accordance with one embodiment of the invention.
Figure 6C:
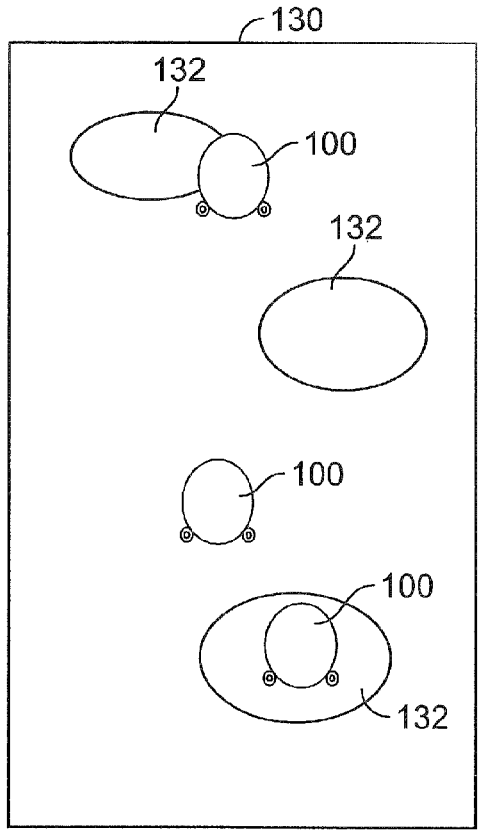
FIG. 6C is an example of a game board in connection with a projectile.
Figure 6B:
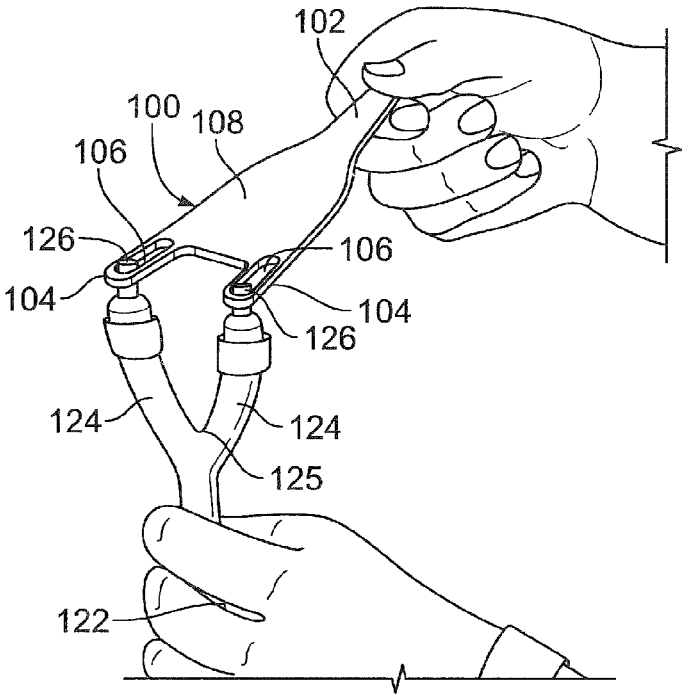
FIG. 6B is an example of a projectile secured to a launcher and being pulled back by a user to prepare the projectile to be propelled.

Referring now to FIGS. 6A, 6B, and 6C there is shown a projectile 100 and launching mechanism 120 in accordance with another embodiment of the present invention. The projectile 100 may also be made from a thermal poly rubber such that when it may be stretched to a length greater than a resting length of the projectile 100. The projectile 100 includes a free end 102 that a user may grasp and a pair of dog ear extending members 104 positioned on another end of the projectile 100 and distal to the free end 102. The dog ear extending members 104 may be a closed loop end member that defines an opening 106 between the loop member and the edge of the main body 108 of the projectile 100. The projectile 100 can be used with a launching mechanism 120. The particular launching mechanism 120 shown in the drawings would have a main handle member 122 with a pair of arm members 124 extending upwardly from an end 125 of the main handle member 122 and away from each other to create an opened space between the arm members 124.

The projectile is simply attached to a launching mechanism 120 by placing the openings 106 on the closed loop end members over tips 126 defined on the arm members 124. The user would grasp the free end and pull back stretching the projectile and building potential energy in the projectile based on the material characteristic of the projectile. By releasing the projectile the user releases the energy and the projectile will fly through the air. To increase the enjoyment of the projectile and launching mechanism, a target board 130 may be included. The target board 130 could include target areas 132. Since the material of the projectiles preferably exhibit a sticky characteristic the projectiles 100 have a tendency to stick to the target board 130.

It is also important to note that the projectiles are unique and novel themselves because the material characteristics are configured to provide a pliable but yet resilient material such that the projectile can be stretched to a length greater then its resting length. The resiliency is however extremely fast, such that the potential energy stored in the projectile when stretched allows the projectile to thrust forward when released. In addition, the projectiles also have a sticky characteristic such that when the projectile strikes a surface it adheres to the surface as well.

In another embodiment, the projectile may include a first portion and a second portion, which may be the same portion or the entire projectile. The first portion being is made of a material having a first characteristic configured to provide a pliable and resilient feature, such that the pliable feature configures the projectile to have a stretchable portion that is stretchable to a length greater then a resting length and the resilient feature configures the projectile to return from a stretched positioned to the resting length. Thus the resiliency is such that a potential energy stored in the projectile when stretched is quickly converted to kinetic energy to launch the projectile. Furthermore, the second portion is made of a material having a second characteristic configured to provide a sticky characteristic such that when the projectile strikes a surface the at least second portion adheres to the surface. This allows the projectile to be used for a variety of uses and games.

Thus, it is apparent that there has been provided, in accordance with the present invention, a projectile toy and a launcher, which fully satisfies the goals, objects, and advantages set forth herein before. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps. Further, the invention illustratively disclosed herein suitably may be practiced in the absence of any element which is not specifically disclosed herein.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element. Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

What is claimed is:

1. A projectile toy and storage device comprising:

a container having two halves, wherein at least a first half includes an internal compartment opening;

a spring loaded hinge joining the two halves together at one end, the two halves being configured to include an opened configuration and a closed configuration, said opened configuration defined as being separated from each other at said hinge such that the internal compartment opening is exposed and said closed configuration defined such that the internal compartment opening is sealed against the other half, and wherein when the container is in a closed configuration said spring loaded hinge is in compression with potential energy to exert a force on the two halves such that the two halves forcefully swing away from each other to the opened configuration when the spring loaded hinge is released from the closed configuration;

an attachment portion being positioned at an end distal to the spring loaded hinge and being positioned within the internal compartment opening;

an elongated projectile having one end secured to the attachment portion, having a body portion configured to be positioned in the internal compartment opening when the container is in a closed configuration, and the elongated projectile having another end distal to said secured end and including a free terminal end; and when the container is in a closed position with the projectile positioned in the internal compartment opening, the release of the spring loaded hinge to move the container to the opened configuration exerts said force on the first half causing the projectile to swing its free terminal end out and away from the first half automatically.

2. The toy and device of claim 1 further comprising a latching mechanism configured to secure the two halves in a closed configuration and a releasing mechanism configured to release the latching mechanism.

3. The toy and device of claim 1, wherein the projectile is made from a thermal poly rubber such that when propelled out of the internal compartment the projectile stretches to a length greater than a resting length of the projectile.

4. The toy and device of claim 1, wherein the free terminal end of said projectile has a material characteristic with a tendency to be tacky such that the free terminal end sticks to an object.

* * * * *